US010589953B2

(12) United States Patent
Allen, Jr. et al.

(10) Patent No.: US 10,589,953 B2
(45) Date of Patent: Mar. 17, 2020

(54) RECONFIGURABLE DIVERTER CONVEYOR

(71) Applicant: A. G. Stacker, Inc., Weyers Cave, VA (US)

(72) Inventors: Clarence C. Allen, Jr., Mt. Crawford, VA (US); Micah C. Sundstrom, Staunton, VA (US); Eric H. Crowe, Weyers Cave, VA (US); Samantha L. J. Armstrong, Churchville, VA (US)

(73) Assignee: A.G. STACKER INC., Weyers Cave, VA (US)

( * ) Notice: Subject to any disclaimer, the term of this patent is extended or adjusted under 35 U.S.C. 154(b) by 651 days.

(21) Appl. No.: 15/235,883

(22) Filed: Aug. 12, 2016

(65) Prior Publication Data

US 2017/0043971 A1 Feb. 16, 2017

Related U.S. Application Data

(60) Provisional application No. 62/204,091, filed on Aug. 12, 2015.

(51) Int. Cl.

| | |
|---|---|
| ***B65H 29/16*** | (2006.01) |
| ***B65H 29/18*** | (2006.01) |
| ***B65H 29/50*** | (2006.01) |
| ***B65H 29/60*** | (2006.01) |
| ***B65H 43/00*** | (2006.01) |

(52) U.S. Cl.

CPC ..... *B65H 29/16* (2013.01); *B65H 29/18* (2013.01); *B65H 29/50* (2013.01); *B65H 29/60* (2013.01); *B65H 43/00* (2013.01); *B65H 2301/4473* (2013.01); *B65H 2404/255* (2013.01); *B65H 2404/2691* (2013.01); *B65H 2404/2693* (2013.01); *B65H 2701/1762* (2013.01)

(58) Field of Classification Search

CPC ..... B65H 29/16; B65H 29/18; B65H 29/50; B65H 29/60; B65H 29/36; B65H 29/38; B65H 2403/731; B65H 2404/253; B65H 2404/2532; B65H 2404/2693

USPC ..... 198/806, 807, 839, 842, 843, 457.03, 198/817, 835

See application file for complete search history.

(56) References Cited

U.S. PATENT DOCUMENTS

| | | | | |
|---|---|---|---|---|
| 3,860,232 A * | 1/1975 | Martin | B65G 47/26 | 198/458 |
| 6,032,788 A * | 3/2000 | Smithers | H05K 13/0069 | 198/817 |
| 6,164,432 A * | 12/2000 | Monsees | B65H 3/042 | 198/459.4 |
| 6,817,604 B2 * | 11/2004 | Ohlmann | B65H 29/12 | 198/817 |

(Continued)

*Primary Examiner* — Thomas A Morrison
(74) *Attorney, Agent, or Firm* — J-Tek Law PLLC; Jeffrey D. Tekanic; Scott T. Wakeman

(57) ABSTRACT

A conveyor includes a plurality of belt support assemblies each having a drive wheel assembly at one end and an idler wheel assembly at the other end. Each of the drive and idler wheel assemblies includes a motion converter for converting the rotational movement of a shaft into linear motion along the shaft and an actuator for selectively engaging the motion converter and the shaft. A controller controls the operation of the shafts and the actuators to selectively and individually control the location of each end of each belt assembly relative to one another and to a centerline of the conveyor.

17 Claims, 9 Drawing Sheets

(56) References Cited

U.S. PATENT DOCUMENTS 7,416,073 B1 * 8/2008 Talken ..... B65G 39/071
198/457.03

* cited by examiner

RECONFIGURABLE DIVERTER CONVEYOR

CROSS-REFERENCE TO RELATED APPLICATIONS

The present application claims the benefit of U.S. provisional patent application No. 62/204,091, filed Aug. 12, 2015, the entire contents of which is hereby incorporated by reference.

FIELD OF THE INVENTION

The present invention is directed to a conveyor having a plurality of belts, each having a first end and a second end, for transporting sheets of material in a longitudinal direction wherein the lateral position the first end of each belt is adjustable, and, more specifically, toward a conveyor having a plurality of belts, each having a first end and a second end, for transporting sheets of material in a downstream direction wherein the lateral position the first end of one of the plurality of belts is automatically adjustable independently of the first end of another one of the plurality of belts.

BACKGROUND OF THE INVENTION

Devices for stacking generally planar articles of material, such as sheets of corrugated material, are well known. One example of a commercially available device is the AGS2000 Rotary Die Cut Stacker made by the assignee of the present invention, A.G. Stacker, Inc., Weyers Cave, Va. Further examples of such devices are disclosed in U.S. Pat. No. 3,321,202 to Geo. M. Martin and U.S. Pat. No. 3,419,266 to Geo. M. Martin, each of which is expressly incorporated herein by reference in its entirety.

As shown in FIGS. 1 and 2, a conventional stacking apparatus 100 generally comprises a layboy section 102 which receives sheets, such as corrugated blanks produced by a rotary die cut machine 103, and discharges the sheets onto a transfer conveyor 104. The transfer conveyor 104 receives the sheets and transports them to a main conveyor 106. The main conveyor 106 has an intake end 108 and a discharge end 110, and the transfer conveyor has an intake end 112 and a discharge end 114. At the main conveyor intake end 108, the main conveyor 106 is mounted to a base 116 at a pivot point 118 so that the main conveyor 106 may be pivoted to raise its discharge end 110. At the discharge end 110 of the main conveyor 106, an accumulator section 120 receives discharged sheets.

The transfer conveyor 104 includes a plurality of parallel belts 122 that extend in a longitudinal or downstream direction from the layboy section 102 to the main conveyor 106. In FIG. 1, these belts are parallel, and the ends of the belts at the intake end 112 and at the discharge end 114 are equally spaced in a transverse direction (transverse to the longitudinal direction). This configuration is adequate for transporting a single stream of sheets. However, it is known to configure a rotary die cut machine to produce multiple (two, three, four or more) streams of sheets simultaneously. It is sometimes desirable to increase the lateral separation between the streams of sheets so that, for example, the stacks formed by the main conveyor section are laterally separated.

It is therefore known to provide a transfer conveyor with belts having ends that can be manually repositioned. For example, if the transfer conveyor has a longitudinal centerline and eight belts, a first set of four belts on one side of the longitudinal centerline and a second set of four belts on the other side of the longitudinal centerline, the downstream ends of each set of belts may be shifted laterally outwardly away from the longitudinal centerline. Two streams of sheets that arrive at the intake end of the conveyor separated by a first distance may thus leave the discharge end of the transfer conveyor separated by a second, greater, distance.

Manually repositioning the ends of the belts of the transfer conveyor can be time consuming, and it may sometimes be difficult to ensure that a given spacing of the belt ends can be repeated accurately each time a particular product is processed. It would therefore be desirable to provide a transfer conveyor having belts the ends of which can be positioned consistently and automatically.

SUMMARY

These and other problems are addressed by embodiments of the present disclosure, a first aspect of which comprises a conveyor having an entry end and a discharge end and which is configured to carry sheets of material from the entry end to the discharge end. The conveyor includes a conveyor frame comprising first and second spaced frame portions, a drive shaft extending between the first and second spaced frame portions, a conveyor drive operably connected to the drive shaft for rotating the drive shaft, and a first drive wheel assembly axially slidably mounted on the drive shaft. The first drive wheel assembly includes a first drive wheel axially slidably mounted on the drive shaft for rotation with the drive shaft and a first drive wheel bracket, and a second drive wheel assembly axially slidably mounted on the drive shaft. The second drive wheel assembly includes a second drive wheel mounted on the drive shaft for rotation with the driveshaft and a second drive wheel bracket. A first arm extends from the first drive wheel bracket and has a first end and a second end. The first end of the first arm is connected to the first drive wheel bracket, and the second end of the first arm includes a first idler wheel assembly comprising a first idler wheel bracket supporting a first idler wheel. A second arm extends from the second drive wheel bracket and has a first end and a second end. The first end of the second arm is connected to the second drive wheel bracket, and the second end of the second arm includes a second idler wheel assembly. The second idler wheel assembly includes a second idler wheel bracket supporting a second idler wheel. A first belt extends from the first drive wheel to the first idler wheel, and a second belt extends from the second drive wheel to the second idler wheel. A first motion converter shaft extends between the first and second frame portions, and a motion converter drive is operably connected to the first motion converter shaft for rotating the first motion converter shaft. A first motion converter is mounted on the first motion converter shaft and is connected to the first drive wheel bracket or is connected to the first idler wheel bracket. The first motion converter is configured to convert rotary motion of the first motion converter shaft into linear motion of the first drive wheel bracket if the first motion converter is connected to the first drive wheel bracket or into linear motion of the first idler wheel bracket if the first motion converter is connected to the first idler wheel bracket. A second motion converter is mounted on the first motion converter shaft and is connected to the second drive wheel bracket or is connected to the second idler wheel bracket.

Another aspect of the disclosure comprises a conveyor having an entry end and a discharge end and that is configured to carry sheets of material from the entry end to the discharge end. The conveyor includes a conveyor frame comprising first and second spaced frame portions, a drive shaft extending between the first and second spaced frame portions, and a conveyor drive operably connected to the drive shaft for rotating the drive shaft. A first drive wheel assembly is axially slidably mounted on the drive shaft, and the first drive wheel assembly includes a first drive wheel mounted on the drive shaft for rotation with the driveshaft and a first drive wheel bracket. A second drive wheel assembly is axially slidably mounted on the drive shaft, and the second drive wheel assembly includes a second drive wheel mounted on the drive shaft for rotation with the driveshaft and a second drive wheel bracket. A first arm extends from the first drive wheel bracket and has a first end and a second end, the first end of the first arm being connected to the first drive wheel bracket. The second end of the first arm includes a first idler wheel assembly comprising a first idler wheel bracket supporting a first idler wheel. A second arm extends from the second drive wheel bracket and has a first end and a second end, and the first end of the second arm is connected to the second drive wheel bracket. The second end of the second arm includes a second idler wheel assembly comprising a second idler wheel bracket supporting a second idler wheel. A first belt extends from the first drive wheel to the first idler wheel, a second belt extends from the second drive wheel to the second idler wheel, and the conveyor includes means for independently positioning the first drive wheel assembly and the second drive wheel assembly and/or means for independently positioning the first idler wheel assembly and the second idler wheel assembly.

DETAILED DESCRIPTION

Figure 3:
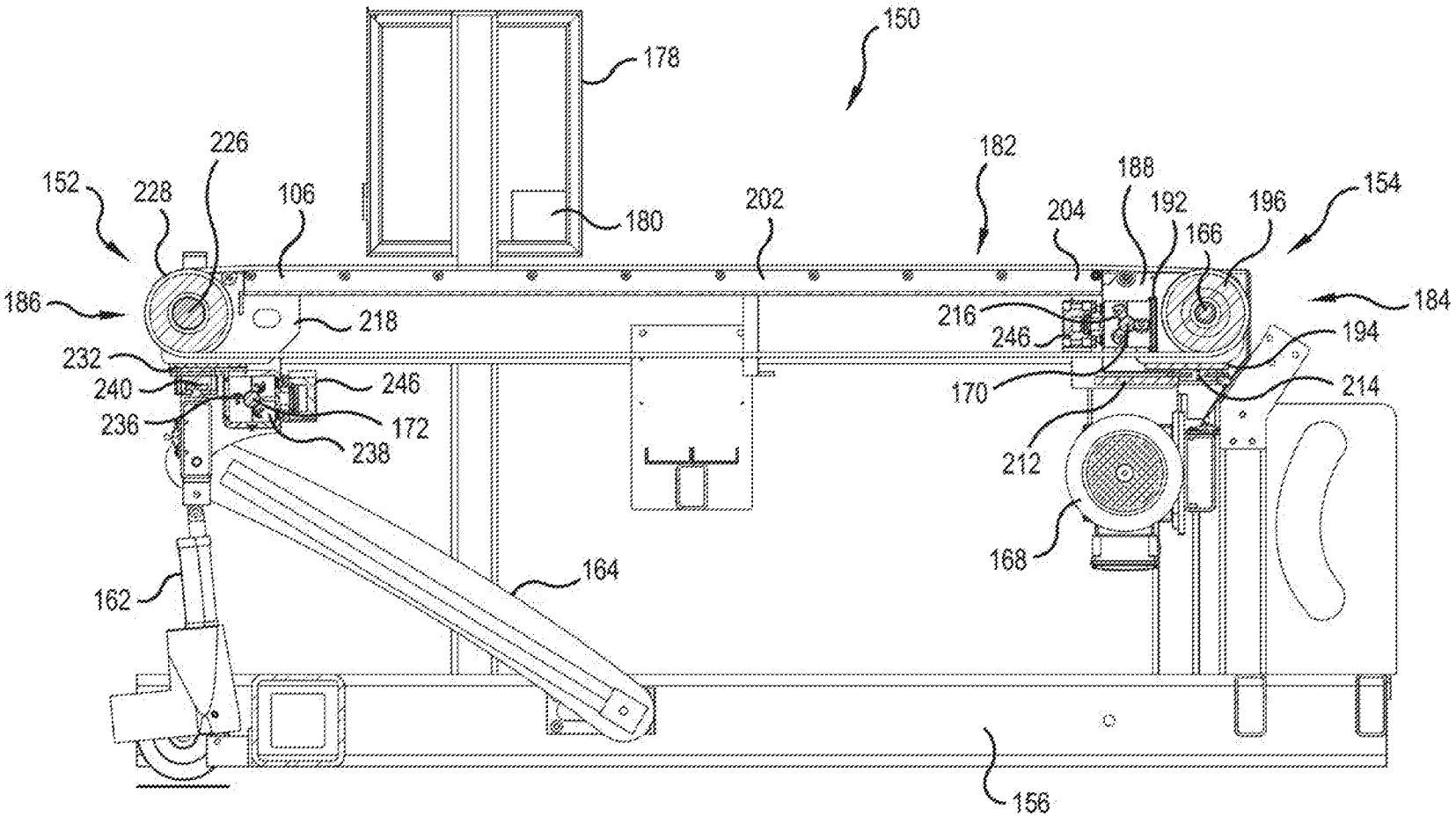
FIG. 3 is a side elevational view of a transfer conveyor according to an embodiment of the present disclosure that is usable in a sheet stacking system.
Figure 4:
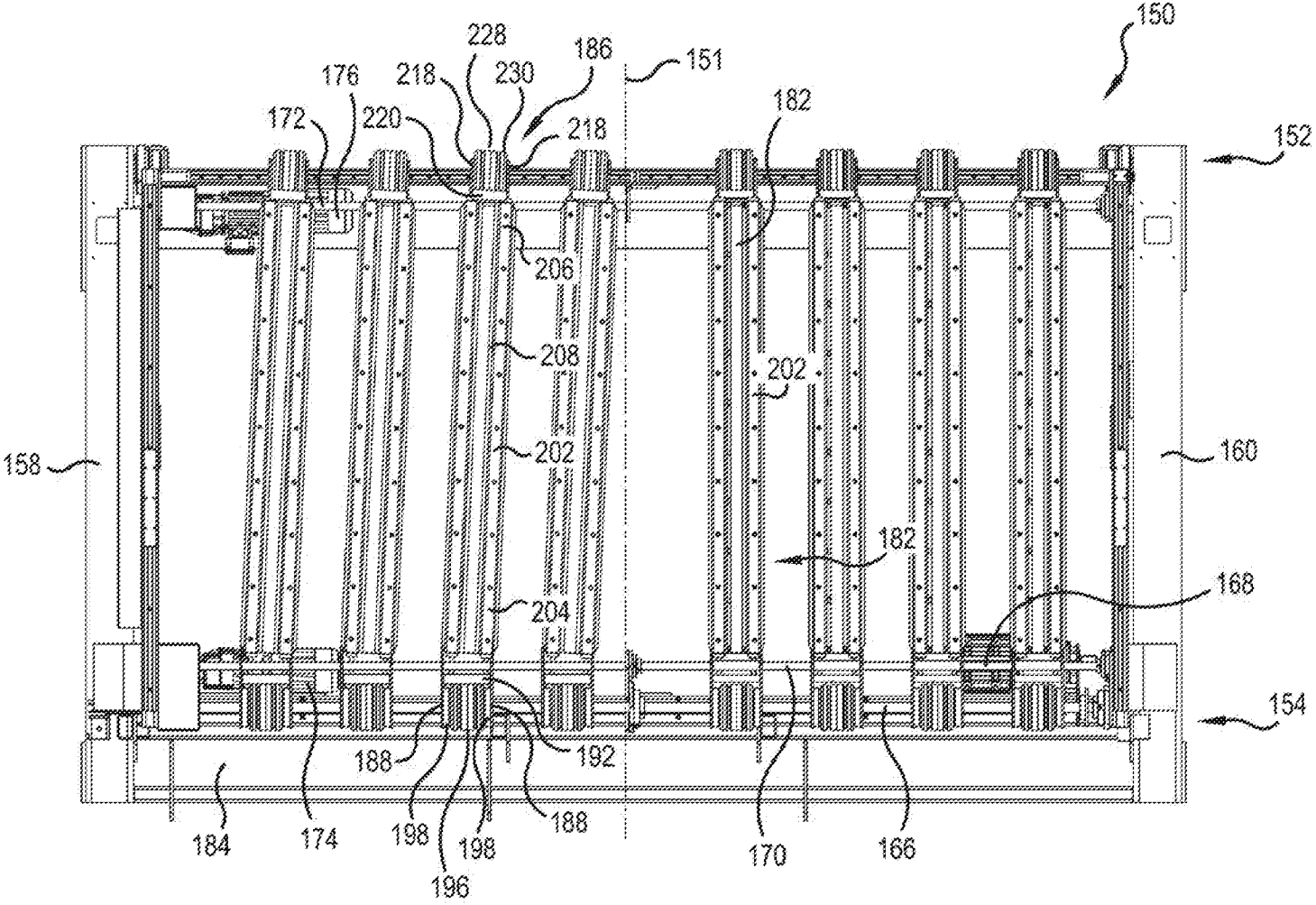
FIG. 4 is a top plan view of the transfer conveyor of FIG. 3 which includes eight belt support assemblies.

Referring now to the drawings, wherein the showings are for purposes of illustrating presently preferred embodiments of the invention only and not for limiting same, FIGS. 3 and 4 show a transfer conveyor 150 having a longitudinal centerline 151, an entry end 152 and a discharge end 154 and a frame including a bottom support 156, a first side portion 158 and a second portion 160. An electric actuator with feedback 162 is connected between the bottom support 156 and the entry end 152 of the transfer conveyor 150 and configured to raise and lower the entry end 152. This allows the entry end 152 to be positioned correctly relative to the location of the output of a layboy conveyor which feeds sheets of material to the transfer conveyor 150. A swing arm 164 is connected between the bottom support 156 and the frame. The angle through which the swing arm 164 can pivot is limited so that the swing arm 164 forms a hard stop and prevents the entry end 152 from dropping below a predetermined minimum height. In this manner, if the actuator 162 fails, the entry end 152 of the transfer conveyor 150 will not drop to the ground.

A driveshaft 166 is rotatably supported between the first side portion 158 and the second side portion 160 of the frame and operably connected to a conveyor drive 168 by a belt (not illustrated) or in another conventional manner. As will be discussed in more detail hereinafter, a first motion converter shaft 170 and a second motion converter shaft 172 are also connected between the first and second side portions 158, 160. The first motion converter shaft 170 is rotatably driven by a first motion converter drive 174, and the second motion converter shaft 172 is rotatably driven by a second motion converter drive 176.

Figure 1:
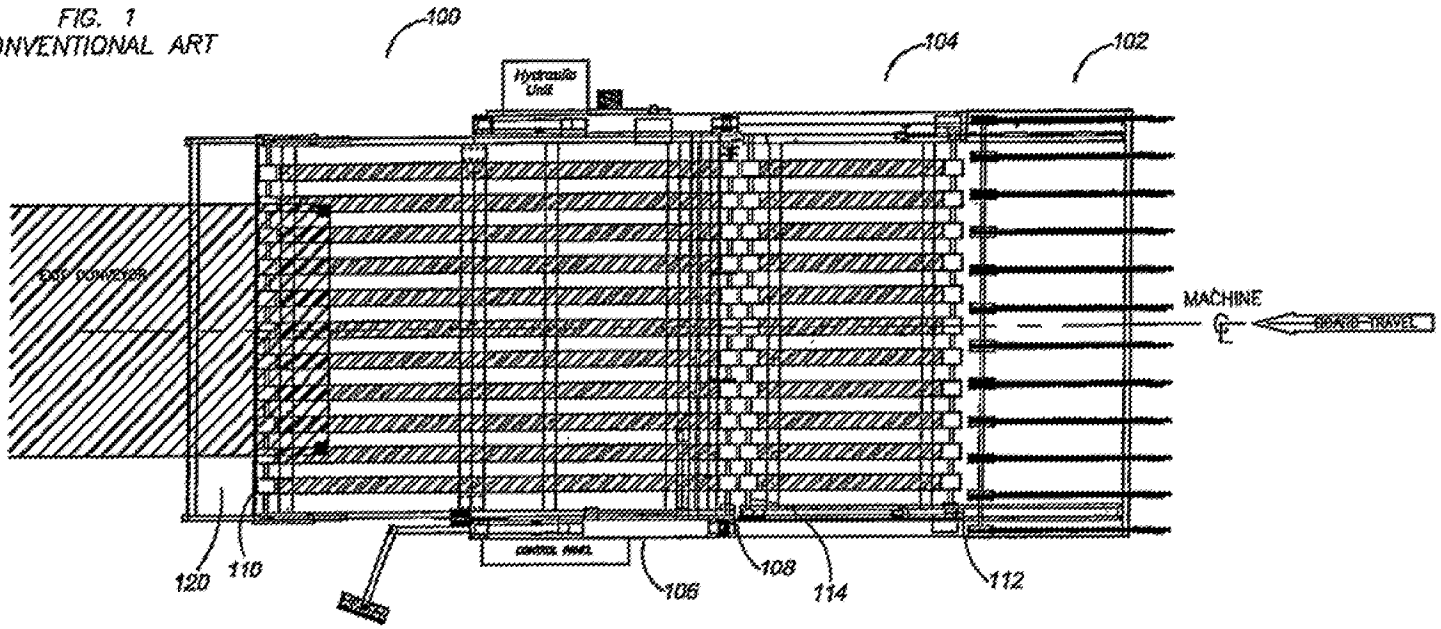
FIG. 1 CONVENTIONAL ART
FIG. 1 is a top plan view of a conventional sheet stacking system including a layboy, a transfer conveyor and a main conveyor.
Figure 2:
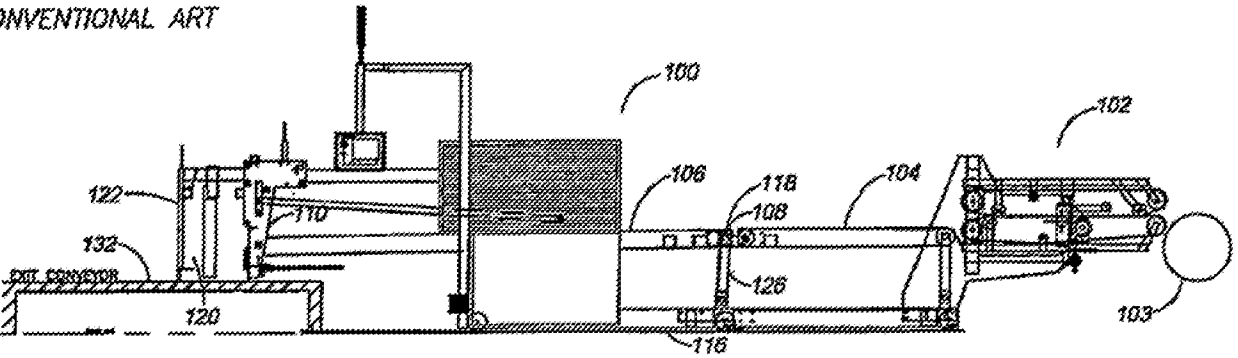
FIG. 2 CONVENTIONAL ART
FIG. 2 is a sectional side elevational view of the sheet stacking system of FIG. 1.

An operator interface 178, including a display (not illustrated) allows a user to input data to a controller 180, which may comprise a programmable logic controller or microprocessor, to control the various actuators of the transfer conveyor 150 that will be described herein as well as to view information produced by the sensors described hereinafter which provide information about the state of the transfer conveyor 150. In the present embodiment, the operator interface 178 is associated with the transfer conveyor 150 alone; in other embodiments, the transfer conveyor 150 may be controlled by a main controller (not illustrated) for a stacking system like the stacking system illustrated in FIGS. 1 and 2 which controller is modified to send and receive appropriate signals to the various portions of the transfer conveyor 150 described herein.

Figure 7:
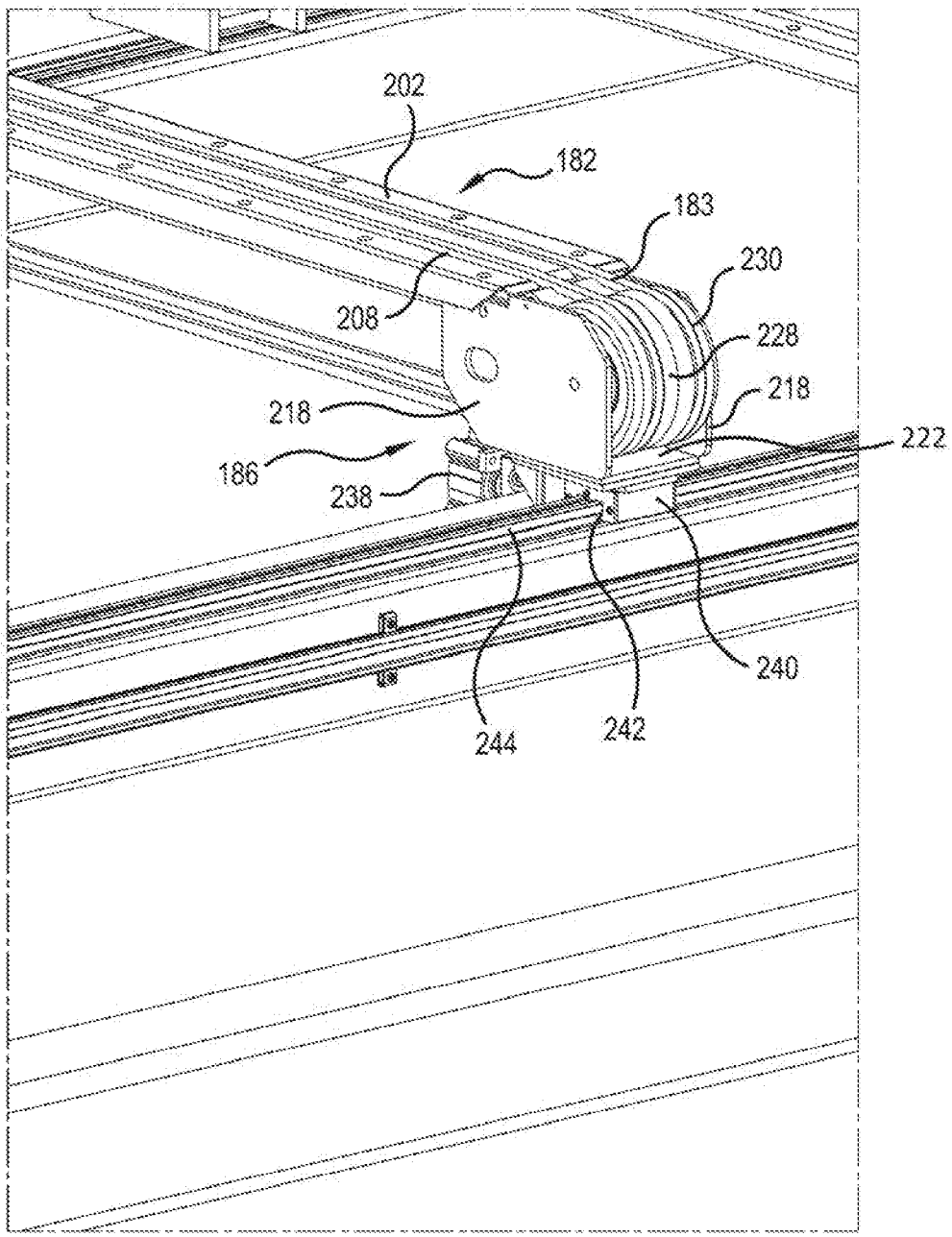
FIG. 7 is perspective view of one end of one of the belt support assemblies of FIG. 3.
Figure 8:
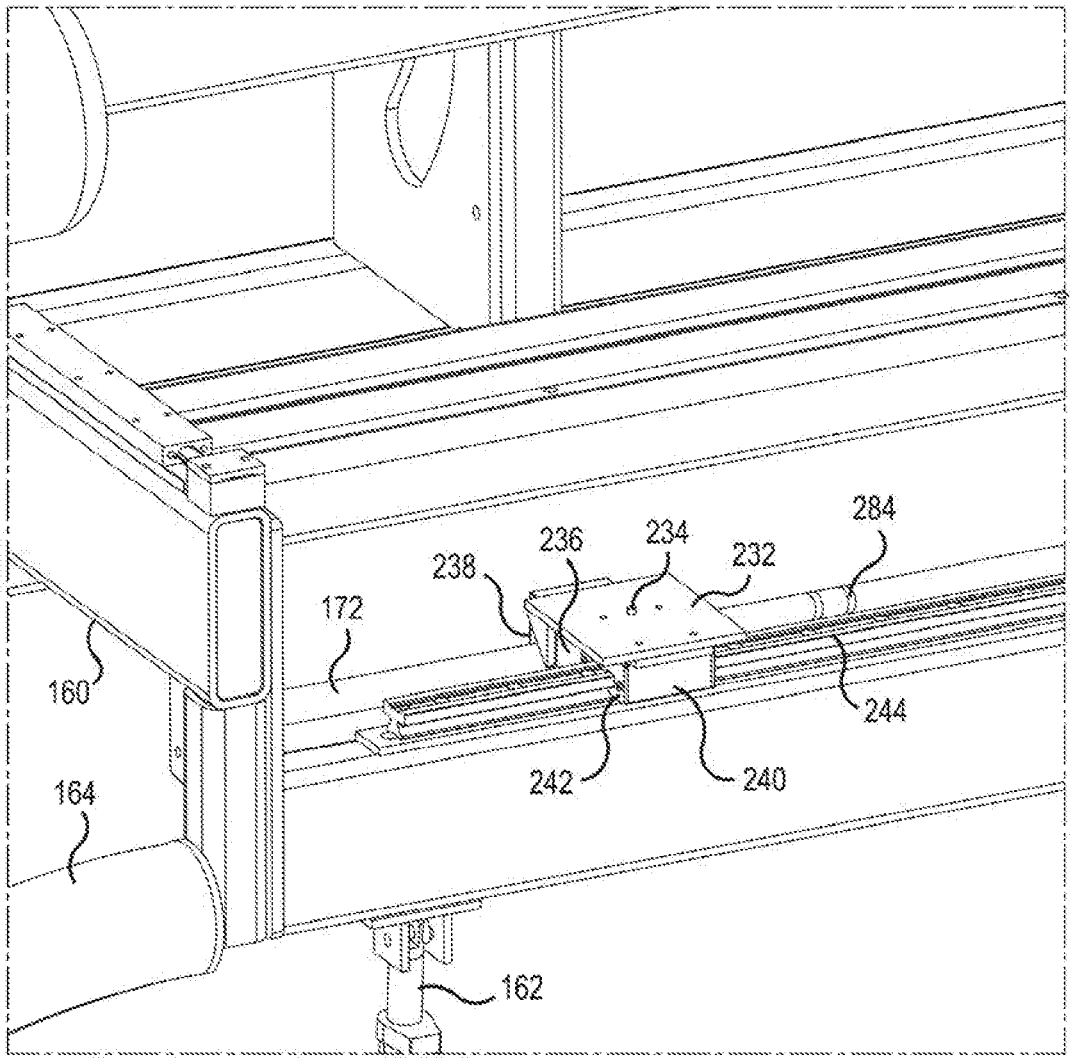
FIG. 8 is a perspective view of a movable support for one end of one of the belt support assemblies of FIG. 3.

A plurality of belt support assemblies 182 are illustrated in FIG. 4. Eight belt support assemblies are shown, but the use of more or fewer belt assemblies 182 is within the scope of this disclosure. A plurality of belts 183 are shown in FIG. 7 but are omitted from other figures for clarity. A first set of the belt support assemblies 182, on the left side of the centerline 151 are angled away from the centerline 151 as they run from the entry end 152 to the discharge end 154 of the transfer conveyor 150. A second set of the belt support assemblies 182, on the right side of the centerline 151 in FIG. 4 are positioned so that they are parallel to the centerline 151. With this configuration, two streams of sheets of material entering the transfer conveyor 150 at the entry end 152 will diverge and exit the transfer conveyor 150 with a larger spacing than when they entered. The belt support assemblies 182 are identical, and the following discussion will focus on a single one of the belt support assemblies 182.

Figure 5:
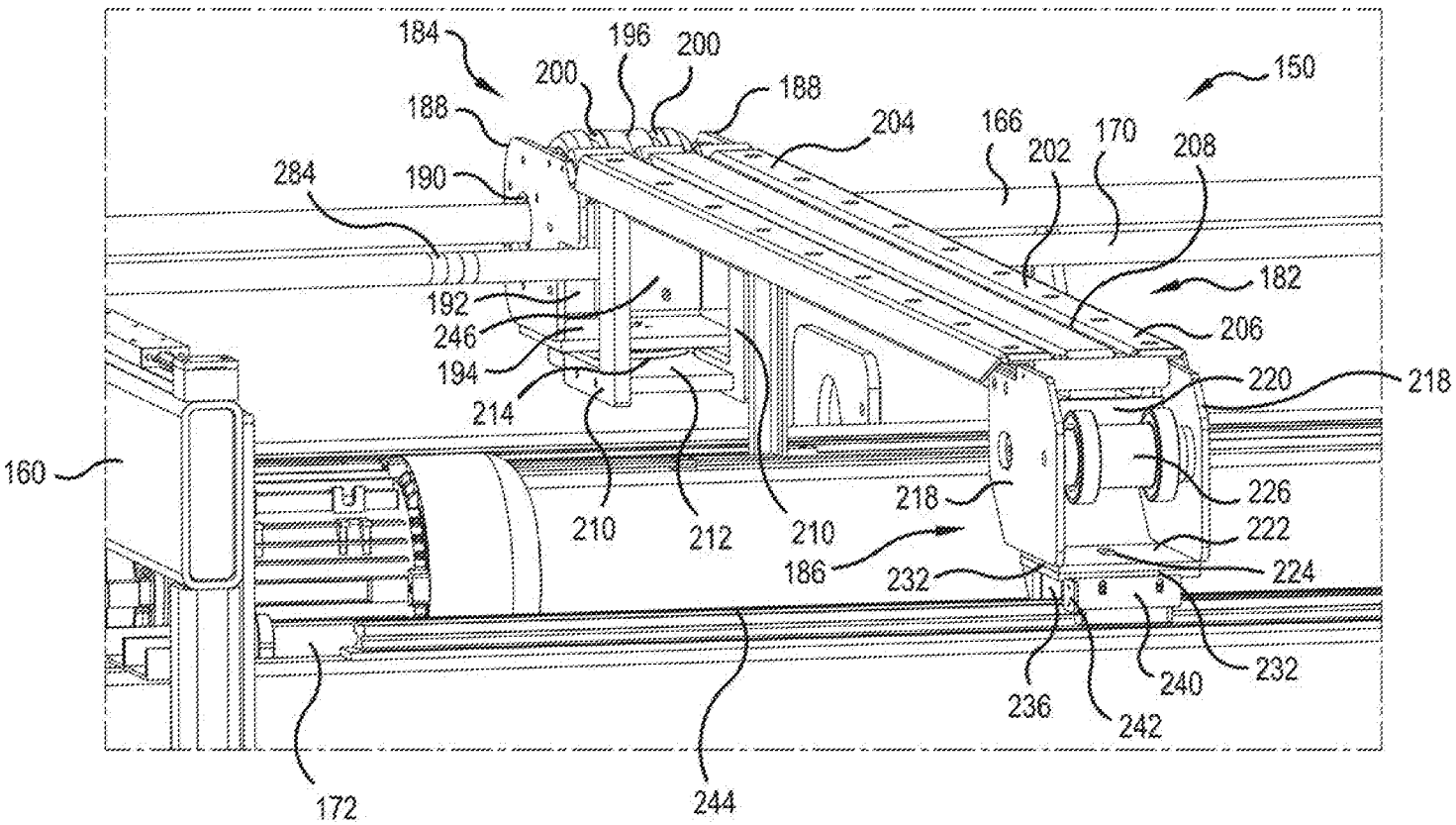
FIG. 5 is a perspective view of part of a single one of the belt support assemblies of FIG. 3.
Figure 6:
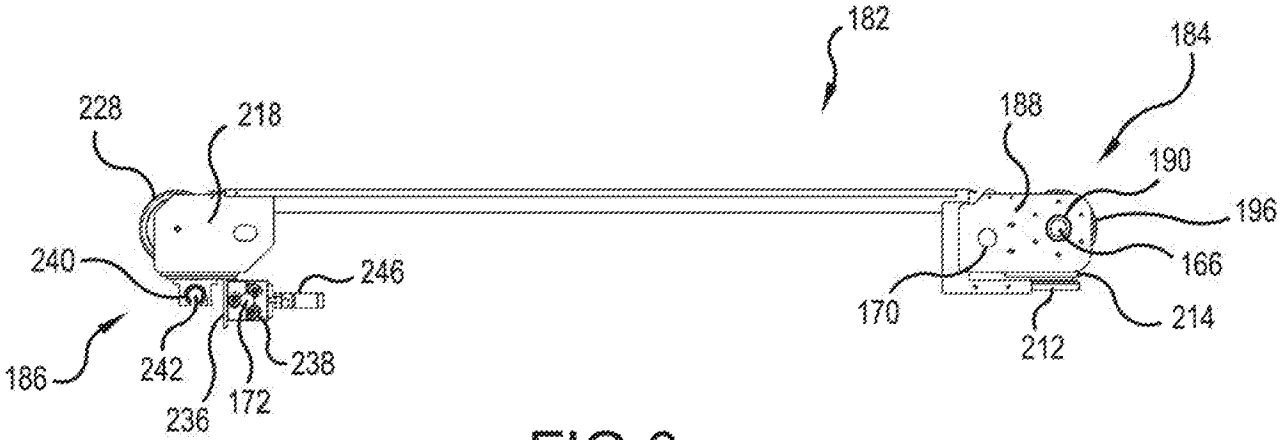
FIG. 6 is a side elevational view of one of the belt support assemblies of FIG. 3.

Referring now to FIG. 5, each of the belt support assemblies 182 includes a drive wheel assembly 184 at the discharge end 154 and an idler wheel assembly 186 at the entry end 152; however, in the alternative, the drive wheel assembly 184 could be located at the entry end 152 and the idler wheel assembly 186 may be located at the discharge end 154.

The drive wheel assembly 184 includes a housing formed of first and second side plates 188 each including an opening 190. A transverse plate 192 and a bottom plate 194 are connected between the first and second side plates 188. The drive shaft 166 extends through the openings 190 in the first and second side plates 188, and a drive wheel 196 is mounted on the drive shaft 166 so that it is rotationally fixed but axially movable on the drive shaft 166. For example, although not specifically illustrated, the drive shaft 166 may include a spline that engages a groove in the interior of the drive wheel 196, or the periphery of the drive shaft 166 may have grooves (not illustrated) that engage with protrusions on the inner opening of the drive wheel 196. First and second plain bearings 198 are mounted on the facing inner portions of the side plates 188 and center the drive wheel 196 for rotational movement between the first and second side plates 188. Also, the drive wheel 196 includes first and second grooves 200 for guiding the belts 183. In the preferred embodiments, the belts 183 have inwardly tapered sides and a trapezoidal cross section and may sometimes be referred to as "V-belts." Belts having a circular cross section could also be used. The shape of the grooves 200 is selected to match the cross sectional shape of the belts being used.

A belt guide 202 extends away from the drive wheel assembly 184 and has a first end 204 near the drive wheel 196 and a second end 206 located near the discharge end 154. The belt guide 202 includes first and second channels 208 for guiding the belts 183 and is configured to support the belts 183 and sheets of material carried by the belts 183, as they are carried along the transfer conveyor 150. Two L-shaped brackets 210 depend from the bottom of the belt guide 202 at the first end 204, and a pivot plate 212 is connected between the horizontal portions of the L-shaped brackets 210. The pivot plate 212 is connected to the bottom plate 194 by a slew ring 214 which connects the pivot plate 212 to the bottom plate 194 while allowing them to rotate relative to one another.

A first motion converter 216 is mounted on the first motion converter shaft 170 and is connected to the transverse plate 192 of the first drive wheel assembly 184. An example of a suitable motion converter 216 is available from Zero-Max, Inc. of Plymouth, Minn. and is sold under the tradename Roh'Lix®. This type of motion converter drive is also shown and described in U.S. Pat. No. 4,947,698 issued to Zero-Max Industries, Inc., and the disclosure of U.S. Pat. No. 4,947,698 is hereby incorporated by reference.

The first motion converter 216 is a device configured to convert the rotary motion of a shaft into linear motion of the motion converter 216. As will be described in more detail below, the first motion converter 216 is configured to selectively engage the first motion converter shaft 170. When the first motion converter 216 is engaged and the first motion converter shaft 170 rotates in a first rotational direction, the first motion converter 216 moves linearly along the first motion converter shaft 170 in a first linear direction. When the first motion converter shaft 170 rotates in a direction opposite the first rotational direction, the first motion converter 216 moves in a second linear direction opposite the first linear direction. The first motion converter 216 is configured to work with a smooth shaft. However, other rotary-to-linear motion converters, such as a ballnut/ballscrew arrangement, or a threaded shaft configured to engage threads on a movable body could be used without exceeding the scope of this disclosure.

The idler wheel assembly 186 is located at the second end 206 of the belt guide 202 and includes first and second side plates 218 connected by a transverse plate 220 and a bottom plate 222 having a slot 224. An idler wheel axle 226 is supported between the first and second side plates 218, and an idler wheel 228, illustrated in FIG. 7, is rotatably mounted on the idler wheel axle 226. The idler wheel 228 includes first and second grooves 230 for receiving the belts 183.

The bottom plate 222 rests on a support plate 232 having a pin 234 that extends into the slot 224 in the bottom plate 222. A connector plate 236 depends from the bottom of the support plate 232, and a second motion converter 238 is mounted on the second motion converter shaft 172 and connected to the connector plate 236. The second motion converter 238 may be identical to the first motion converter 216 described above. A slide 240 is also attached to the bottom of the support plate 232 and includes a groove 242 having a shape complementary to the cross section of a guide rail 244 mounted on the frame of the transfer conveyor 150 between the first and second side portions 158, 160.

The configurations of the drive wheel assemblies 184 and idler wheel assemblies 186 allows the relationship between the belt support assemblies 182 and the centerline 151 of the transfer conveyor 150 to be changed without affecting the ability of each of the belt support assemblies 182 to carry sheets of material. Specifically, the slew ring 214 connecting the bottom plate 194 to the pivot plate 212 allows the belt guide 202 to pivot relative to the drive shaft 166 while the rotational axis of the drive wheel 196 remains coaxial with the axis of the drive shaft 166. In addition, the bottom plate 222 of each idler wheel assembly rests on a pivot plate 232 such that the pin 234 of each pivot plate 232 extends through the slot 224 in the bottom plate 222. When the idler wheel assemblies 186 are moved transversely along the second motion converter shaft 172, the second end 206 of the belt guide 202 traverses an arc. The bottom plate 222 pivots on the pivot plate 232, and the length of the slot 224 allows the bottom plate 222 to slide longitudinally while also pivoting with respect to the pivot plate 232. The belts 183 are sufficiently flexible that they continue to rotate around the drive wheels 196 and the idler wheels 228 as the angular relationships between the belt support 202 and the first motion converter shaft 170 and the second motion converter shaft 172 change.

The first motion converter 216 and the second motion converter 238 each include an actuator 246 for selectively disengaging the motion converters 216, 238 from their respective motion converter shafts 170, 172. While the motion converters themselves are conventional, the actuator 246 for selectively controlling the engagement of each motion converter 216, 238 with a respective shaft 170, 172 is not. The actuator 246 connected to the first motion converter 216 is discussed below; the actuator 246 connected to the second motion controller 238 is structurally identical to the actuator 246 connected to the first motion converters 216.

The actuator 246 comprises a first block 248 having a mounting surface 250 attached to the side of the connector plate 236 facing the entry end 152 and an inner surface 252, and a first bearing 254. The actuator also includes a second block 256 having a mounting surface 258 at which the second block 256 is attached to the actuator 246, an inner surface 260 that faces the inner surface 252 of the first block 248, and second and third bearings 254. The first block 248 includes first and second threaded bores 262 in the inner surface 252. The second block includes first and second small bores 264 in the inner surface 260 which small bores 262 communicate with large bores 266 in the mounting surface 258 of the second block 256.

The second block 256 is connected to the first block 248 by first and second bolts 268 each having a head 270. The bolts 268 are inserted, threaded ends first, into the large bores 266 in the mounting surface 258 and extend out of the small bores 264 in the inner surface 260 of the second block 256 and into the threaded bores 262 of the first block 248. A compression spring 272 is located in each of the larger bores 266 and extends between a bottom of the large bores 266 and the head 270 of each bolt 268. Threading the bolts 268 into the threaded bores 262 compresses the springs 272 in the large bores 266. The biasing force provided by the springs 272 pushes the heads 270 away from the first block 248 and thus pulls the first block 248 and the second block 256 toward one another.

The first block 248 and the second block 256 define between them a circular shaft opening 274 through which the first motion converter shaft 170 passes. The force with which the first block 248 and the second block 256 are pulled toward one, and thus the force with which the first motion controller 216 grips the first motion controller shaft 170, is determined by the degree to which the springs 272 are compressed. The gripping force produced by the first motion converter 216 can be released by pressing the heads 270 of the bolts 268 toward the large bore 266 while holding the second block 256 fixed because this will move the first block 248 and the second block 256 away from one another. A more detailed description of the structure and operation of the first motion converter 216 may be obtained from the aforementioned U.S. Pat. No. 4,947,698.

The actuator 246 is mounted to the mounting surface 258 of the second block 256 by a bolt 276. The actuator 246 includes first and second blocks 278 on a housing 280 of the actuator that contact the heads 270 of the first and second bolts 268 and a piston 281 in the housing 280 connected to the bolt 276. When the piston 281 is caused to retract into the housing 280, it pulls the head of the bolt 276, and hence the attached second block 256 away from the first block 248.

Actuator 246 may include a pneumatic cylinder. The heads 270 of the bolts 268 are thus pressed into the large bores 266 and this causes the first and second blocks 248, 256 to separate. This in turn disengages the first motion converter 216 from the first motion converter shaft 170. While one or more of the bearings 254 might remain in contact with the first motion converter shaft 170, the inventors have found that the above-described separation of the first and second blocks 248, 256 is adequate to prevent rotary motion of the first motion converter shaft 170 from being converted into linear motion by the first motion converter 216.

Figure 9:
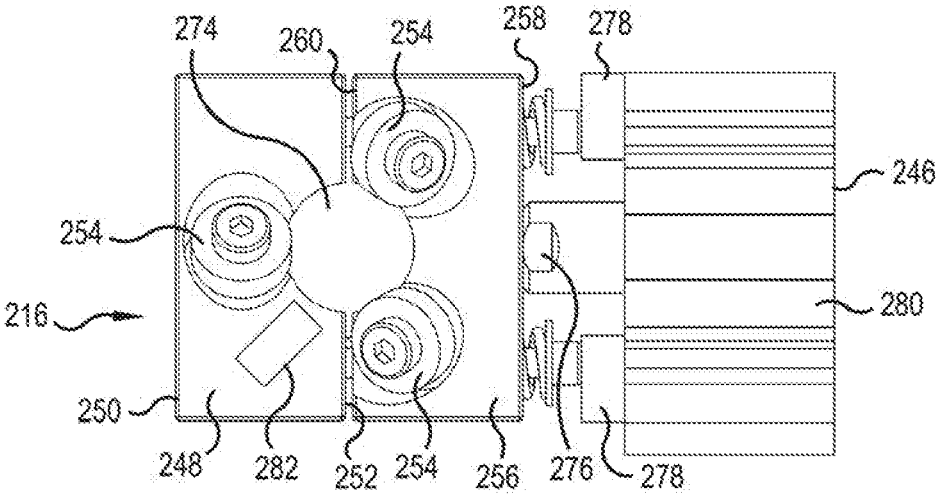
FIG. 9 is a first side elevational view of a motion converter for moving ends of the belt support assemblies of FIG. 3.
Figure 10:
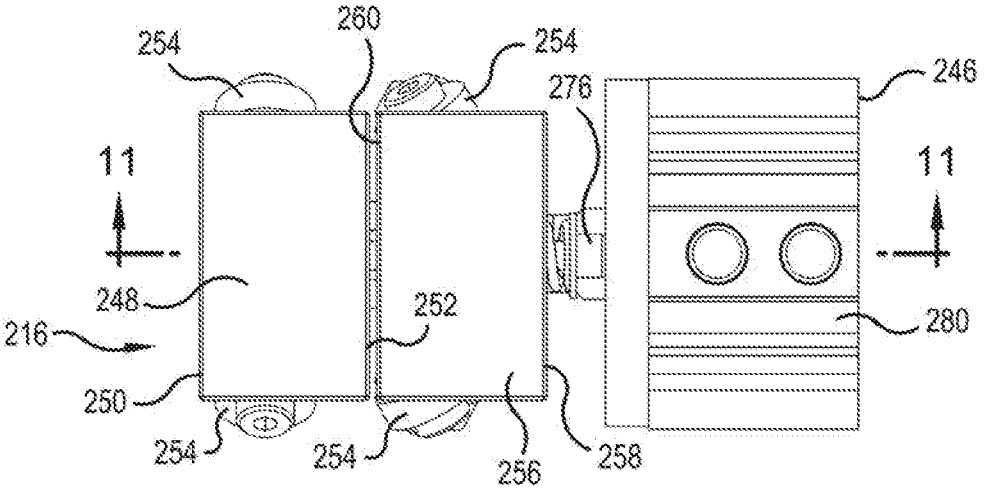
FIG. 10 is a second side elevational view of the motion converter of FIG. 9.
Figure 11:
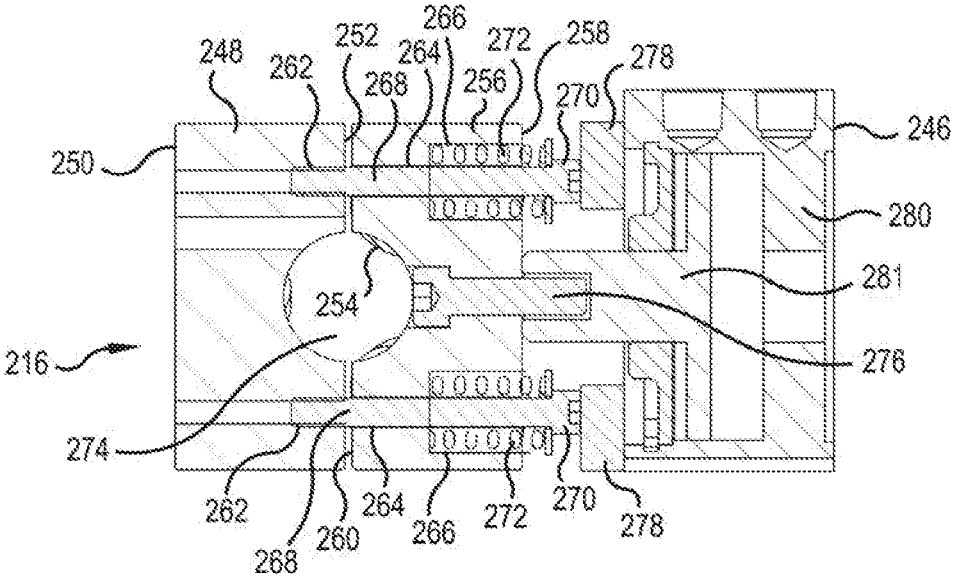
FIG. 11 is a sectional side elevational view in the direction of line 11-11 in FIG. 10.

A first linear encoder 282 (FIG. 9) is mounted on the first block 248 of the motion converter 246 that is mounted on the drive wheel assembly 184, and the linear encoder 282 is configured to read markers 284 along the first motion converter shaft 170 and to generate an output signal indicative of the location of the linear encoder 282, and hence the actuator 246 along the first motion converter shaft 170. The markers 284 may be optical or magnetic depending on the type of linear encoder used. In the present embodiment, the linear encoder 282 is configured to detect magnetic markers 284 in the first motion converter shaft 170. A second linear encoder 282 is mounted on the first block 248 of the motion converter 246 connected to the idler wheel assembly 186 and is configured to read markers 284 in the second motion converter shaft 172. Other locations for the first and second linear encoders 282 and other locations for the markers 284, for example in the guide rail 284 are also possible.

The controller 180 is configured to receive user input from the operator interface 178 and from the first and second linear encoders 282. The controller 180 is also configured to generate output signals for controlling the operation of the main conveyor drive 188, the electric actuator 162, the first motion converter shaft drive 174 and the second motion converter shaft drive 176 and for controlling the actuators 246. The controller 180 may also include a memory in which a program for operating the aforementioned control elements in a particular manner is stored.

The operation of the transfer conveyor 150 will now be described for moving the four belt support assemblies 182 that are located to the left of the centerline 151 in FIG. 4 from a starting position (not illustrated) in which each of the belt support assemblies 182 are parallel to the centerline 151 to the position illustrated in FIG. 4 in which the ends of the belt support assemblies 182 at the discharge end 154 of the transfer conveyor 150 are shifted toward the centerline 151.

The absolute positions of each of the drive wheel assemblies 184 and the each of the idler wheel assemblies 186 may be known to the controller 180 and stored in the memory of the controller 180 based on the known ending positions of these elements during a previous positioning operation. Alternately, the positions of each of the drive wheel assemblies 184 and the idler wheel assemblies 186 may be determined by the linear encoders 282 sensing the markers 284. If the linear encoders 282 cannot sense the markers 284 without moving relative to the markers 284, each end of each of the belt support assemblies 182 may be moved as follows to allow the controller 180 to determine a starting position. The following is a description of a method of determining the positions of the drive wheel assemblies 184: the positions of the idler wheel assemblies 186 can be determined in a similar manner.

The controller 180 first sends a signal to the actuators 246 associated with all but a first one of the drive wheel assemblies 184 to cause the actuators 246 to extend the pistons 278 and disengage the first motion converters 216 from the first motion converter shaft 170. The controller 180 then signals the first motion converter drive 176 to rotate the first motion converter shaft 170 in a first direction. The rotation of the first motion converter shaft 170 causes the motion converter 216 of the first one of the drive wheel assemblies 184 to begin moving in a first direction. This movement will cause the linear encoder 282 to move past markers 184 in the first motion converter shaft 170 and to generate signals indicative of the position of the linear encoder 282 along the first motion converter shaft 170.

After the position of the first one of the drive wheel assemblies 184 is determined and stored in the memory of the controller 180, the actuator 246 of the first one of the drive wheel assemblies 184 is caused to disengage the first motion converter 216 from the first motion converter shaft 170 and to cause the actuator 246 of a second one of the drive wheel assemblies 184 to engage the first motion converter shaft 170. This process is repeated for each of the drive wheel assemblies 184 and for each of the idler wheel assemblies 186. Alternately, with a suitably configured controller 180, it may be possible to engage all of the actuators 246 and move all of the first motion converters 216 and second motion converters 238 simultaneously and have the controller 180 determine their positions simultaneously.

From the known starting positions of each of the drive wheel assemblies 184 and the idler wheel assemblies 186, the belt support assemblies 182 can be moved into a desired configuration. The process of allowing a user to set the positions of each of the idler wheel assemblies 186 of the belt support assemblies 182 to the left side of the centerline 151 in FIG. 4 will first be described.

Using the operator interface 178, the user will disengage all the actuators 246 associated with the idler wheel assemblies 186 from the second motion converter shaft 172 and then cause the second motion converter shaft drive 176 to rotate the second motion converter shaft 172 in a first direction, a direction for moving the idler wheel assemblies 186 to the right in FIG. 4. The user will then control the actuator 246 of the belt support assembly 182 closest to the centerline 151 to engage the second motion control shaft 172 and watch the movement of the engaged idler wheel assembly 186 toward the centerline 151 until it reaches a desired location relative to the centerline 151. This may be done, for example by pressing a button (or virtual button on a screen) of the operator interface 178 to engage the relevant actuator 246 and pressing the button again or releasing the button to disengage the relevant actuator 246.

If the idler wheel assembly 186 moves too far toward the centerline 151, the operator can move the given idler wheel assembly away from the centerline 151 by reversing the direction of the second motion converter shaft 172. The positions of the remaining idler wheel assemblies 186 and the drive wheel assemblies 184 are set in a similar manner. When all belt support assemblies 182 are located and oriented as desired, the locations of each of the drive wheel assemblies 184 and each of the idler wheel assemblies 186 are saved in the memory of the controller 180 so that the belt support assemblies 182 can be caused to return to this saved position in the future without the need to set their locations individually.

In this manner, once a particular configuration of the belt support assemblies is established directly by a user, that configuration can be saved in the memory of the controller 180 and recalled the next time that particular configuration is required for the type of sheets being processed.

The present invention has been described herein in terms of a preferred embodiment. Modifications and additions to this embodiment will become apparent to persons of ordinary skill in the art upon a reading of this disclosure. It is intended that all modifications and additions comprise a part of the present invention to the extent they fall within the scope of the several claims appended hereto.

What is claimed is:

1. A conveyor having an entry end and a discharge end configured to carry sheets of material from the entry end to the discharge end, the conveyor comprising:

a conveyor frame comprising first and second spaced frame portions;

a drive shaft extending between the first and second spaced frame portions and having an axis of rotation;

a conveyor drive operably connected to the drive shaft for rotating the drive shaft;

a first drive wheel assembly axially slidably mounted on the drive shaft, the first drive wheel assembly including a first drive wheel mounted on the drive shaft for rotation with the drive shaft and a first drive wheel bracket;

a second drive wheel assembly axially slidably mounted on the drive shaft, the second drive wheel assembly including a second drive wheel mounted on the drive shaft for rotation with the driveshaft and a second drive wheel bracket;

a first arm extending from the first drive wheel bracket and having a first end and a second end, the first end of the first arm being connected to the first drive wheel bracket, the second end of the first arm including a first idler wheel assembly comprising a first idler wheel bracket supporting a first idler wheel;

a second arm extending from the second drive wheel bracket and having a first end and a second end, the first end of the second arm being connected to the second drive wheel bracket, the second end of the second arm including a second idler wheel assembly comprising a second idler wheel bracket supporting a second idler wheel;

a first belt extending from the first drive wheel to the first idler wheel;

a second belt extending from the second drive wheel to the second idler wheel;

a first motion converter shaft extending between the first and second frame portions and having an axis of rotation;

a motion converter drive operably connected to the first motion converter shaft for rotating the first motion converter shaft;

a first motion converter mounted on the first motion converter shaft and connected to the first drive wheel bracket or connected to the first idler wheel bracket, the first motion converter being configured to convert rotary motion of the first motion converter shaft into linear motion of the first drive wheel bracket if the first motion converter is connected to the first drive wheel bracket or into linear motion of the first idler wheel bracket if the first motion converter is connected to the first idler wheel bracket; and a second motion converter mounted on the first motion converter shaft and connected to the second drive wheel bracket or connected to the second idler wheel bracket, wherein the first motion converter is shiftable between an engaged configuration in which the first motion converter is engaged with the first motion converter shaft and moves in the axial direction of the first motion converter shaft when the first motion converter shaft rotates and a disengaged configuration in which the first motion converter is disengaged from the first motion converter shaft and does not move in the axial direction of the first motion converter shaft when the first motion converter shaft rotates.

2. The conveyor according to claim 1, wherein the second motion converter is shiftable between an engaged configuration in which the second motion converter moves in the axial direction of the first motion converter shaft when the first motion converter shaft rotates and a disengaged configuration in which the second motion converter does not move in the axial direction of the first motion converter shaft when the first motion converter shaft rotates, and wherein the first motion converter is shiftable between the engaged configuration and the disengaged configuration independently of the configuration of the second motion converter.

3. The conveyor according to claim 2, wherein the first motion converter comprises an upper block supporting a first bearing on a first side of the first motion converter shaft and a lower block supporting a second bearing on a second side of the first motion converter shaft and means for biasing the first block toward the second block to hold the first bearing against the first side of the first motion converter shaft and hold the second bearing against the second side of the first motion converter shaft.

4. The conveyor according to claim 2, wherein the first motion converter comprises an upper block supporting a first bearing on a first side of the first motion converter shaft and a lower block supporting a second bearing on a second side of the first motion converter shaft and a spring biasing the first block toward the second block and holding the first bearing against the first side of the first motion converter shaft and holding the second bearing against the second side of the first motion converter shaft.

5. The conveyor according to claim 4, including an actuator connected to the first block and connected to the second block and configured to move the first block away from the second block and overcome a biasing force of the spring.

6. The conveyor according to claim 5, wherein the actuator comprise a pneumatic cylinder.

7. The conveyor according to claim 6, including a controller configured to control the conveyor drive and the motion converter drive and the pneumatic cylinder.

8. The conveyor according to claim 1, further including a second motion converter shaft extending between the first and second frame portions and having an axis of rotation, wherein the first motion converter is connected to the first drive wheel bracket and wherein the second motion converter is connected to the second drive wheel bracket, and further including a third motion converter connected to the first idler wheel bracket and a fourth motion converter connected to the second idler wheel bracket, the third motion converter being configured to convert rotary motion of the second motion converter shaft into linear motion of a third idler wheel bracket and the fourth motion converter being configured to convert rotary motion of the second motion converter shaft into linear motion of a second idler wheel bracket.

9. The conveyor according to claim 1, wherein the drive shaft is located at the entry end of the conveyor.

10. The conveyor according to claim 8, wherein the first end of the first arm is pivotably connected to the first drive wheel bracket and the first end of the second arm is pivotably connected to the second drive wheel bracket.

11. The conveyor according to claim 10, wherein the second end of the first arm is pivotably connected to the first idler wheel bracket and the second end of the second arm is pivotably connected to the second idler wheel bracket.

12. The conveyor according to claim 11, wherein the conveyor includes a guide rail and wherein the first idler bracket is slidably mounted on the guide rail and the second idler bracket is slidably mounted on the guide rail.

13. The conveyor according to claim 12, including a second linear encoder configured to output a signal indicative of an axial location of the first idler wheel relative to the guide rail.

14. The conveyor according to claim 1, wherein the first belt is received in a guide channel in the first arm and the second belt is received in a guide channel in the second arm.

15. A method of controlling the conveyor according to claim 2 comprising:

shifting the first motion converter into the engaged configuration;

shifting the second motion converter into the engaged configuration;

operating the motion converter drive to rotate the first motion converter shaft;

shifting the first motion converter into the disengaged position while the motion converter shaft is rotating; and after shifting the first motion converter into the disengaged position, shifting the second motion converter into the disengaged position.

16. A conveyor having an entry end and a discharge end configured to carry sheets of material from the entry end to the discharge end, the conveyor comprising:

a conveyor frame comprising first and second spaced frame portions;

a drive shaft extending between the first and second spaced frame portions and having an axis of rotation;

a conveyor drive operably connected to the drive shaft for rotating the drive shaft;

a first drive wheel assembly axially slidably mounted on the drive shaft, the first drive wheel assembly including a first drive wheel mounted on the drive shaft for rotation with the drive shaft and a first drive wheel bracket;

a second drive wheel assembly axially slidably mounted on the drive shaft, the second drive wheel assembly including a second drive wheel mounted on the drive shaft for rotation with the driveshaft and a second drive wheel bracket;

a first arm extending from the first drive wheel bracket and having a first end and a second end, the first end of the first arm being connected to the first drive wheel bracket, the second end of the first arm including a first idler wheel assembly comprising a first idler wheel bracket supporting a first idler wheel;

a second arm extending from the second drive wheel bracket and having a first end and a second end, the first end of the second arm being connected to the second drive wheel bracket, the second end of the second arm including a second idler wheel assembly comprising a second idler wheel bracket supporting a second idler wheel;

a first belt extending from the first drive wheel to the first idler wheel;

a second belt extending from the second drive wheel to the second idler wheel;

a first motion converter shaft extending between the first and second frame portions and having an axis of rotation;

a motion converter drive operably connected to the first motion converter shaft for rotating the first motion converter shaft;

a first motion converter mounted on the first motion converter shaft and connected to the first drive wheel bracket or connected to the first idler wheel bracket, the first motion converter being configured to convert rotary motion of the first motion converter shaft into linear motion of the first drive wheel bracket if the first motion converter is connected to the first drive wheel bracket or into linear motion of the first idler wheel bracket if the first motion converter is connected to the first idler wheel bracket;

a second motion converter mounted on the first motion converter shaft and connected to the second drive wheel bracket or connected to the second idler wheel bracket, and a first linear encoder configured to output a signal indicative of an axial location of the first drive wheel on the drive shaft.

17. A conveyor having an entry end and a discharge end and configured to carry sheets of material from the entry end to the discharge end, the conveyor comprising:

a conveyor frame comprising first and second spaced frame portions;

a drive shaft extending between the first and second spaced frame portions and having an axis of rotation;

a conveyor drive operably connected to the drive shaft for rotating the drive shaft;

a first drive wheel assembly axially slidably mounted on the drive shaft, the first drive wheel assembly including a first drive wheel mounted on the drive shaft for rotation with the driveshaft and a first drive wheel bracket;

a second drive wheel assembly axially slidably mounted on the drive shaft, the second drive wheel assembly including a second drive wheel mounted on the drive shaft for rotation with the driveshaft and a second drive wheel bracket;

a first arm extending from the first drive wheel bracket and having a first end and a second end, the first end of the first arm being connected to the first drive wheel bracket, the second end of the first arm including a first idler wheel assembly comprising a first idler wheel bracket supporting a first idler wheel;

a second arm extending from the second drive wheel bracket and having a first end and a second end, the first end of the second arm being connected to the second drive wheel bracket, the second end of the second arm including a second idler wheel assembly comprising a second idler wheel bracket supporting a second idler wheel;

a first belt extending from the first drive wheel to the first idler wheel;

a second belt extending from the second drive wheel to the second idler wheel;

means for positioning the first drive wheel assembly independently of the second drive wheel assembly and means for positioning the second drive wheel assembly independently of the first drive wheel assembly, and/or means for positioning the first idler wheel assembly independently of the second idler wheel assembly and means for positioning the second idler wheel assembly independently of the first idler wheel assembly.

* * * * *